US007380916B2

(12) United States Patent
Sugahara

(10) Patent No.: US 7,380,916 B2
(45) Date of Patent: Jun. 3, 2008

(54) LIQUID DELIVERY APPARATUS

(75) Inventor: Hiroto Sugahara, Ama-gun (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 436 days.

(21) Appl. No.: 10/944,913

(22) Filed: Sep. 21, 2004

(65) Prior Publication Data

US 2005/0069430 A1 Mar. 31, 2005

(30) Foreign Application Priority Data

Sep. 29, 2003 (JP) ..... 2003-338382

(51) Int. Cl.
*B41J 2/045* (2006.01)

(52) U.S. Cl. ..... 347/68; 347/70

(58) Field of Classification Search ..... 347/68–72
See application file for complete search history.

(56) References Cited

U.S. PATENT DOCUMENTS 6,291,927 B1 * 9/2001 Percin et al. ..... 310/324
6,364,468 B1 * 4/2002 Watanabe et al. ..... 347/68
6,540,339 B2 * 4/2003 Cruz-Uribe ..... 347/70

FOREIGN PATENT DOCUMENTS

JP 05-050593 A 3/1993
JP A-9-104109 4/1997
JP 2001-096745 A 4/2001

* cited by examiner

*Primary Examiner*—Stephen D. Meier
*Assistant Examiner*—Geoffrey Mruk
(74) *Attorney, Agent, or Firm*—Oliff & Berridge, PLC

(57) ABSTRACT

A liquid delivery apparatus comprises a pressure chamber accommodating a liquid, and a piezoelectric actuator plate which is disposed to close the pressure chamber and is deformed to deliver the liquid through an opening in communication with the pressure chamber. The actuator plate has a laminated structure including a piezoelectric layer which is deformable at least in a planar direction thereof by an application of an electric field to the piezoelectric layer, and a planar diaphragm laminated on the piezoelectric layer. A rigidity of the piezoelectric actuator plate is lower at a portion thereof over an inner side of an inner peripheral part of the pressure chamber than at a portion thereof over the inner peripheral part of the pressure chamber.

20 Claims, 9 Drawing Sheets

LIQUID DELIVERY APPARATUS

The present application is based on Japanese Patent Application No. 2003-338382 filed on Sep. 29, 2003, the content of which is incorporated herein by reference.

BACKGROUND OF THE INVENTION

1. Field of the Invention

The present invention relates to a liquid delivery apparatus, and particularly to a liquid delivery apparatus actuated by a piezoelectric element.

2. Discussion of Related Art

For instance, there is conventionally known an ejecting apparatus where a plurality of pressure chambers each accommodating a liquid is closed by a diaphragm which is deflected by a piezoelectric element so as to eject a droplet of the liquid from a nozzle. In such an apparatus, since the pressure applied to the liquid accommodated in the pressure chamber is increased with an increase in the amount of deflection of the diaphragm, the diaphragm is desired to be easily deformable or displaceable.

A technique to increase the deflection of the diaphragm is disclosed in JP-A-9-104109 for instance, which teaches an ink jet head in which a piezoelectric element of unimorph type is disposed on a plurality of segments extending inward from a peripheral part of a pressure chamber having a circular shape when seen in a direction perpendicular to the plane of the diaphragm while not actuated. The central part of the diaphragm partially defining the pressure chamber is pressed by the piezoelectric element to eject a liquid droplet. According to this technique, the amount of expansion or displacement of the diaphragm can be increased. However, the structure of this ink jet head is complicated. In addition, when the piezoelectric element is actuated, both of the segments disposed on a lower surface of the piezoelectric element and the diaphragm disposed on an upper surface of the piezoelectric element, need to be deformed in accordance with the displacement of the piezoelectric element. This leads to inefficiency in the displacement of the diaphragm.

SUMMARY OF THE INVENTION

The present invention has been developed in view of the above-described situations, and therefore an object of the invention is to provide a liquid delivery apparatus comprising a piezoelectric element, and a diaphragm which is actuated by the piezoelectric element to deliver a liquid, which apparatus is simple in structure but capable of efficiently deforming the diaphragm, so that the amount of deformation or displacement of the diaphragm can be effectively increased.

The above object may be attained according to the invention which provides a liquid delivery apparatus comprising a pressure chamber accommodating a liquid, and a piezoelectric actuator plate which is disposed to close the pressure chamber and is deformed to deliver the liquid through an opening in communication with the pressure chamber. The actuator plate has a laminated structure including a piezoelectric layer which is deformable at least in a planar direction thereof by an application of an electric field to the piezoelectric layer, and a planar diaphragm laminated on the piezoelectric layer. A rigidity of the piezoelectric actuator plate is lower at a portion thereof over an inner side of an inner peripheral part of the pressure chamber than at a portion thereof over the inner peripheral part of the pressure chamber.

That is, according to the present apparatus, the rigidity of the piezoelectric actuator plate is lowered at the part corresponding to the central part of the piezoelectric layer, enabling to effectively increase the displacement of the diaphragm.

In the above apparatus, the piezoelectric layer is activated at the outer periphery of the central part, while the rigidity of the piezoelectric actuator plate at the portion corresponding to the central part of the piezoelectric layer is lowered. Therefore, the ink in the pressure chamber is efficiently delivered outside through the opening.

The liquid delivery apparatus may be such that the diaphragm extends across the pressure chamber, and the piezoelectric layer is disposed over the inner peripheral part of the pressure chamber and does not extend over the inner side of the inner peripheral part of the pressure chamber.

Alternatively, the liquid delivery apparatus may be such that the diaphragm extends across the pressure chamber, and the piezoelectric layer has a first part extending over the inner peripheral part of the pressure chamber and a second part extending over the inner side of the inner peripheral part of the pressure chamber, the second part being thinner than the first part.

According to the apparatus, the piezoelectric layer is present at least at the position corresponding to the inner peripheral part of the pressure chamber, while the inner or second part of the piezoelectric layer positionally corresponding to a part of the pressure chamber on the inner side of the inner peripheral part may be a void, or formed of the second part having a thickness smaller than the first part of the piezoelectric layer which positionally corresponds to the inner peripheral part of the pressure chamber. Hence, the rigidity of the piezoelectric actuator plate is lowered at a portion corresponding to the inner or second part of the piezoelectric layer compared to the portion positionally corresponding to the inner peripheral part of the pressure chamber, enabling to effectively increase the displacement of the diaphragm.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which.

DETAILED DESCRIPTION OF THE PREFERRED EMBODIMENTS

There will be described several embodiments of the invention by reference to the accompanying drawings.

First Embodiment

Figure 1:
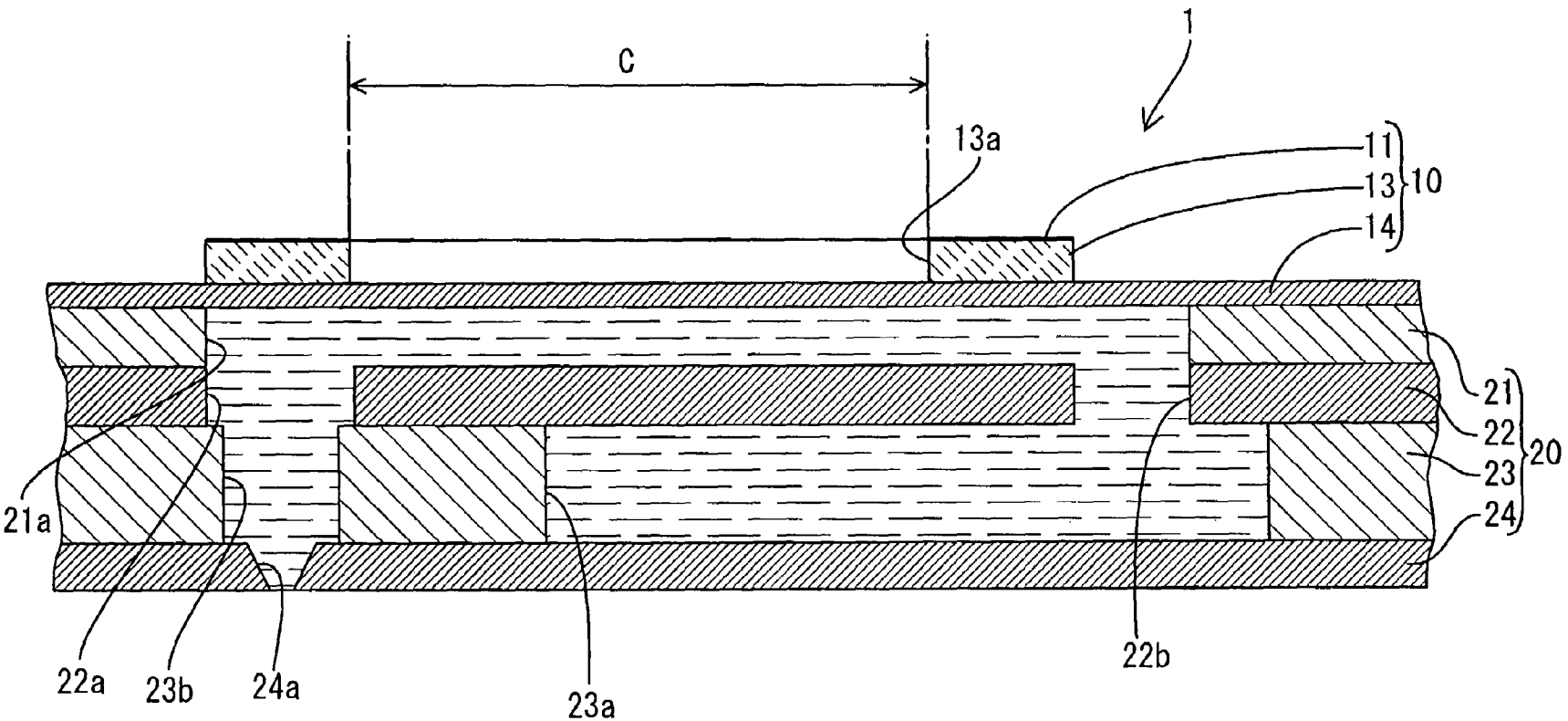
FIG. 1 is a cross sectional view of a liquid delivery apparatus according to a first embodiment of the present invention, as taken along a line extending in a longitudinal direction of a pressure chamber.
Figure 2:
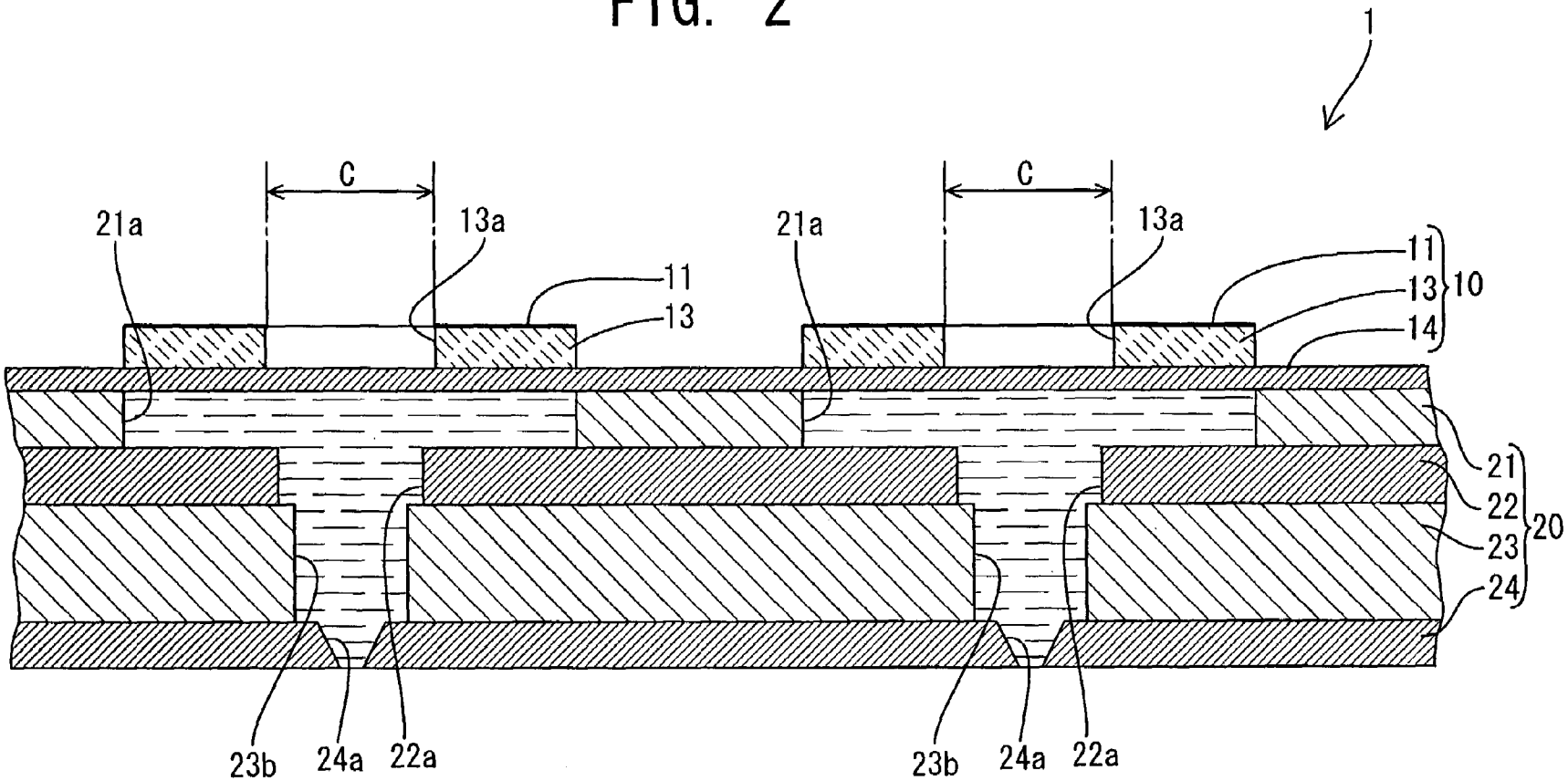
FIG. 2 is a cross sectional view taken in a direction of an array of a plurality of pressure chambers of the liquid delivery apparatus.
Figure 3:
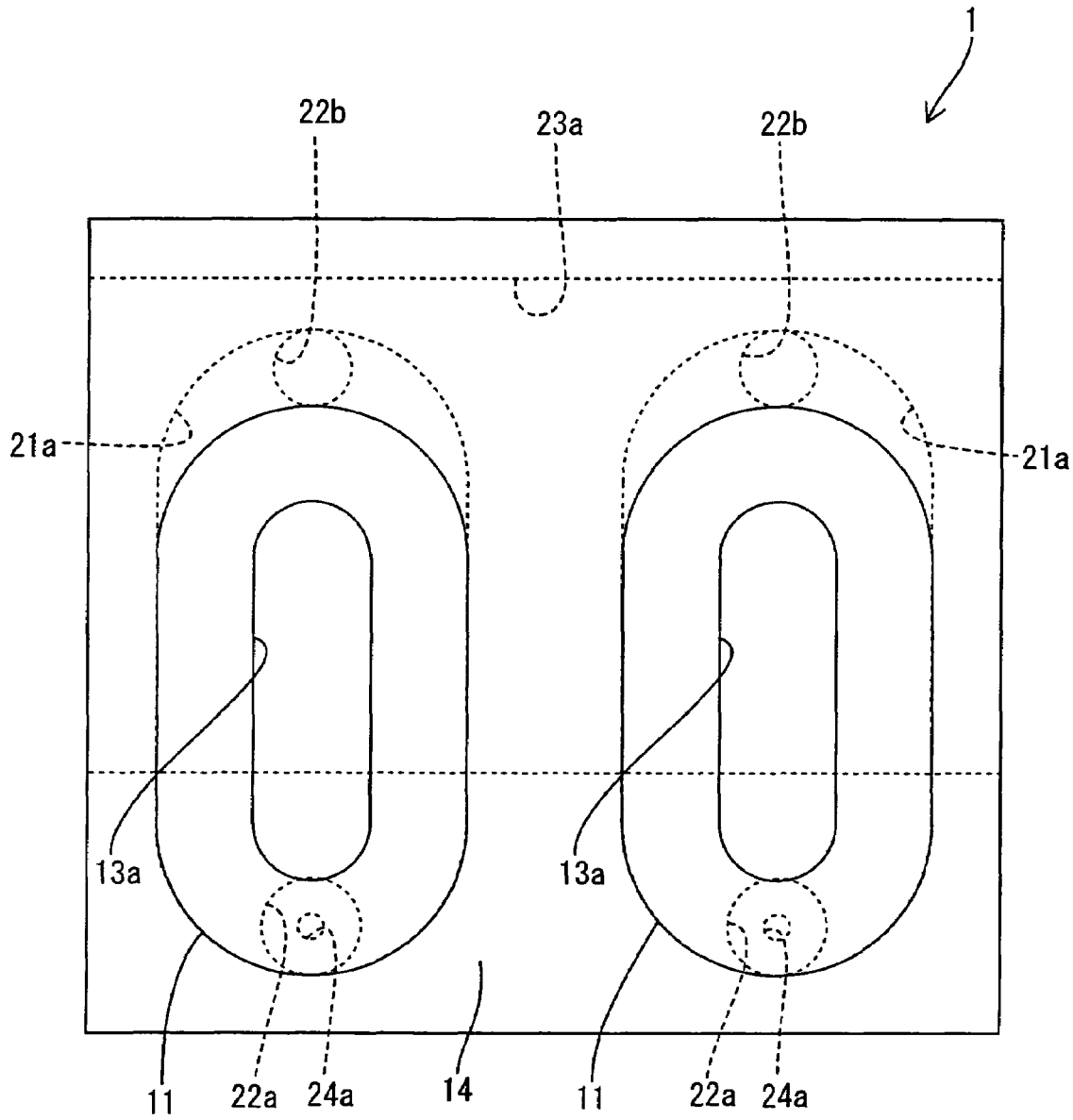
FIG. 3 is a plan view of the liquid delivery apparatus.
Figure 4:
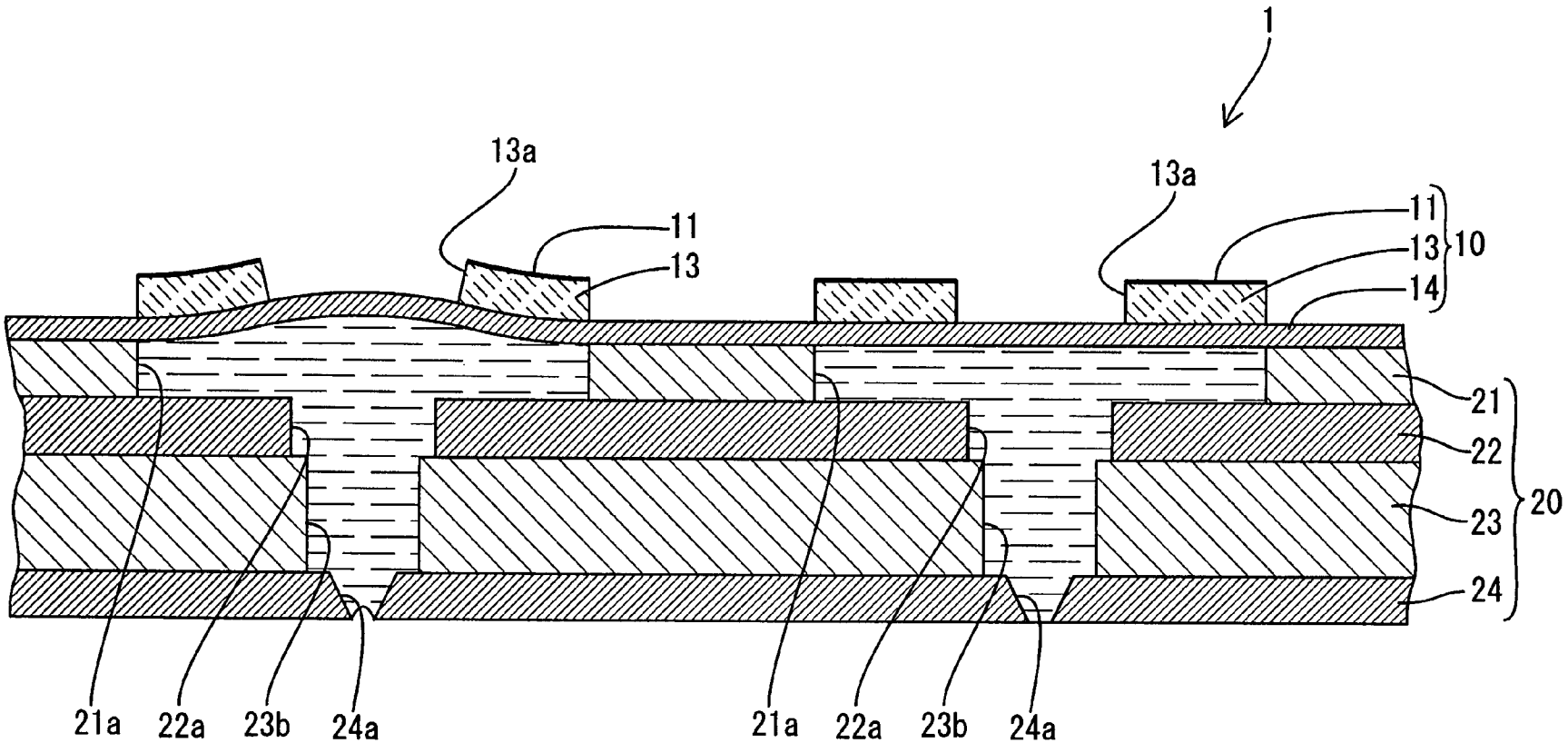
FIG. 4 is a cross sectional view of the liquid delivery apparatus when activated.

Referring to FIGS. 1-4, there will be described a liquid delivery apparatus 1 according to a first embodiment of the invention. FIG. 1 shows a cross sectional view of one of a plurality of pressure chambers 21*a* of the liquid delivery apparatus 1, taken along a line extending in the longitudinal direction of the chamber, while FIG. 2 is a cross sectional view of the apparatus 1 taken along an array of the plurality of pressure chambers 21*a*. FIG. 3 is a plan view of the apparatus 1 shown in FIGS. 1 and 2, while FIG. 4 is an explanatory view illustrating a state where the apparatus 1 is activated.

As shown in FIGS. 1 and 2, the liquid delivery apparatus 1 of the present embodiment takes, for example, the form of an ink jet head for emitting a jet of an ink, as a kind of liquid ejecting apparatus capable of emitting a jet of a liquid. The liquid delivery apparatus comprises a cavity plate 20 including a plurality of pressure chambers 21*a* in each of which is accommodated the ink to be ejected, and a piezoelectric actuator plate 10 bonded to the cavity plate 20 to partially define the pressure chambers 21*a*.

The cavity plate 20 has a multilayer structure in which are defined ink passages, and which includes: a nozzle plate 24 having ink ejecting nozzles 24*a* which are arranged in a row and each of which constitutes an "opening" as defined in the present invention; a manifold plate 23 superposed on the nozzle plate 24; a passage plate 22 superposed on the manifold plate 23; and a chamber plate 21 superposed on the passage plate 22. The plates 21-24, each of which is a generally planar member, are bonded to one another with an epoxy adhesive having a thermosetting property.

Each of the chamber plate 21, passage plate 22 and manifold plate 23 is formed of a metallic material such as a stainless steel. The chamber plate 21 is configured to partially define each of a plurality of pressure chambers 21*a* arranged in a row, and each chamber 21*a* accommodates the ink to be ejected in accordance with selective operation of a piezoelectric actuator plate 10 which will be described later. The passage plate 22 is configured to define pressure passages 22*a* and manifold passages 22*b*. Each of the pressure chambers 21*a* is in communication with one of the pressure passages 22*a* and one of the manifold passages 22*b*, at opposite end portions of the pressure chamber 21*a* in the longitudinal direction of the pressure chamber 21*a*. The manifold plate 23 is configured to partially define: a manifold 23*a* in communication with a liquid tank (not shown); and nozzle passages 23*b* respectively connected to the corresponding pressure passages 22*a*. As shown in FIG. 3, the manifold 23*a* extends in the direction of the array of the pressure chambers 21*a* to be in communication with all the pressure chambers 21*a*.

The nozzle plate 24 is made of a polyimide resin and is configured to define or include nozzles 24*a* respectively connected to the corresponding nozzle passages 23*b*, as shown in FIG. 1. In the liquid delivery apparatus 1 constructed as described above, the liquid or ink stored in the liquid tank is supplied to the nozzles 24*a* via the manifold 23*a*, manifold passages 22*b*, pressure chambers 21*a*, pressure passages 22*a* and nozzle passages 23*b*.

There will next be described a piezoelectric actuator plate 10.

As shown in FIGS. 1 and 2, the piezoelectric actuator plate 10 has a laminated structure comprising a diaphragm 14 which is formed of a metallic material having an electric conductivity, such as a stainless steel, in a substantially planar member. Piezoelectric layers 13, which are mutually separated by a distance in a planar direction of the multilayer structure, are disposed on the diaphragm 14, and an upper electrode 11 is disposed on the opposite surface (i.e., a surface remote from the diaphragm 14) of each of the piezoelectric layers 13. The diaphragm 14 serves as the lower one of a pair of electrodes consisting of an upper electrode and a lower electrode which are disposed on respective opposite surfaces of each piezoelectric layer 13 so as to apply an electric field to the piezoelectric layer 13. According to this arrangement, provision of an exclusive common electrode serving as one of a pair of electrodes can be omitted. This feature is advantageous in terms of reduction of the manufacturing cost.

The upper electrode 11 is a thin conductive film bonded to or printed on the upper surface of each piezoelectric layer 13, and is electrically connected to a positive voltage source of a drive circuit via a switching device (not shown). On the other hand, the diaphragm 14 serving as the lower electrode is connected to a ground of the drive circuit.

Each piezoelectric layer 13 is, as shown in FIGS. 1-3, formed on a part of the diaphragm 14 positionally corresponding to an entirety of an inner peripheral part of a corresponding one of the pressure chambers 21*a*. The upper electrode 11 disposed on the corresponding piezoelectric layer 13 has a planar shape substantially the same as that of the layer 13, that is, the upper electrode 11 is formed along and above the entirety of the inner peripheral part of the corresponding pressure chamber 21*a*. Each pressure chamber 21*a* has an oblong shape, more specifically, a rectangular shape with rounded corners, when seen from the upper side. Each piezoelectric layer 13 also has an oblong shape or a rectangular shape with rounded corners, similar to the planar shape of the pressure chamber 21*a*, but a longitudinal dimension of the layer 13 is smaller than that of the pressure chamber 21*a*. There is a void 13*a* formed through each piezoelectric layer 13 at an inner area C which positionally corresponds to a central part of the corresponding pressure chamber 21*a*, and thus the piezoelectric layer 13 has an annular shape having a substantially constant width.

As shown in FIGS. 1 and 2, the piezoelectric actuator plate 10 is configured so as to be constituted solely by the diaphragm 14 at the inner area C of each piezoelectric layer 13 which positionally corresponds to the central part of the corresponding pressure chamber 21*a*. In other words, the piezoelectric layer 13 and upper electrode 11 are not present or formed at the inner area C, so that a rigidity of the actuator plate 10 at each inner area C is lowered. By this arrangement, the displacement of the piezoelectric layer 13 does not directly affect a portion of the diaphragm 14 which positionally corresponds to the inner area C; the displacement of the piezoelectric layer 13 affects a portion of the diaphragm 14 which positionally corresponds to an outer circumference of the inner area C. Thus, the diaphragm 14 is deflected based on its deformation at the affected portion, namely, the portion where the diaphragm 14 is bonded to the piezoelectric layer 13. More specifically, in this embodiment, a part of the diaphragm positionally corresponding to the inner area C is deformed to be convex upward, due to the downward deflection of the portion bonded to the piezoelectric layer 13. The operation of the apparatus 1 will be described later.

As shown in FIG. 3 which is a plan view of the apparatus 1, the inner area C or the void 13*a* defined inside each piezoelectric layer 13 takes an oblong shape which is similar to, and one size smaller than, that of each pressure chamber 21*a*. In other words, the void 13*a* is formed through the piezoelectric layer 13 to be oblong and open at and around the center of the piezoelectric layer 13, and an area which the void 13*a* occupies in the planar direction corresponds to the inner area C. In this embodiment, the void 13*a* is disposed such that the void 13*a* does not extend over an area of a corresponding one of the pressure passages 22*a* in the planar direction; the entirety of the piezoelectric layer 13 is disposed on a portion of the surface of the diaphragm 14 which does not overlap, and is not positioned over, the planar area of a corresponding one of the manifold passages 22*b*. Such a void 13*a* is formed by etching or machining performed on a planar material which is eventually formed into the piezoelectric layer 13. As shown in FIG. 3, in this embodiment each inner area C is located at a position substantially corresponding to the central part of one corresponding pressure chamber 21*a*, and a dimension of the inner area C in the direction of its shorter side or of the width of the pressure chamber 21*a*, is about one third of the width of the pressure chamber 21*a*. In other words, when sectioned along a line extending in the direction of the shorter sides of the pressure chambers 21*a*, each piezoelectric layer 13 is present in two parts, over the laterally opposite peripheral parts of the pressure chamber 21*a*. Each of the two parts of the piezoelectric layer 13 in such a cross section has a width equal to about one third of the width of the pressure chamber 21*a*, and the inner area C having a width of about one third of the width of the pressure chamber 21*a* is defined between the two parts of the piezoelectric layer 13. This arrangement enables efficient deformation of the piezoelectric actuator plate 10.

The piezoelectric layers 13 are formed of a piezoelectric ceramic material, more specifically, lead (Pb)-zirconate-titanate (PZT). However, other materials may be employed for the piezoelectric layers 13, as long as they are a piezoelectric material; for instance, barium titanate, lead titanate, or Rochelle salt may be employed. The piezoelectric layers 13 are formed on the diaphragm 14 in a uniform thickness, as shown in FIGS. 1 and 2. For instance, when bonding each piezoelectric layer 13 and the diaphragm 14 to each other, the upper electrode 11 is first superposed on the piezoelectric layer 13 prepared in advance, and the assembly of the electrode 11 and the piezoelectric layer 13 is bonded to the diaphragm 14 with an adhesive or others having an electric conductivity. However, the piezoelectric layer 13 and the diaphragm 14 may be otherwise bonded to each other.

There will be now described an operation or activation of the liquid delivery apparatus 1, by reference to FIGS. 2 and 4.

The liquid delivery apparatus 1 is configured such that in a non-operated state of the apparatus 1, as shown in FIG. 2, an electric voltage is not applied between the electrodes, and the piezoelectric actuator plate 10 is not deflected. When ejection of the liquid is required, more specifically, when an ink droplet is required to be ejected from one of the nozzles 24*a* of the apparatus 1, a power supply voltage is applied to the upper electrode 11 on the piezoelectric layer 13 located above a pressure chamber 21*a* corresponding to the nozzle 24*a*, by turning on the switching device. Then, there is induced a potential difference between the upper electrode 11 and the diaphragm 14, applying an electric field to the piezoelectric layer 13. Electrically polarized in the direction of the application of the electric field, the piezoelectric layer 13 expands in the direction of its thickness (in the vertical direction as seen in FIG. 2) and contracts in its planar direction (i.e., the lateral direction as seen in FIG. 2).

As shown on the left-hand side in FIG. 4, when the piezoelectric layer 13, which is disposed on the diaphragm 14 having a rigidity, at a position corresponding to the inner peripheral part of the pressure chamber 21*a*, contracts in the planar direction of the piezoelectric actuator plate 10, there is caused a downward deflection of a part of the actuator plate 10 where the piezoelectric layer 13 in question is present. Since the outer circumference of the piezoelectric layer 13 is virtually fixed to the cavity plate 20 via the diaphragm 14, the deflection of the piezoelectric layer 13 is limited and thus the piezoelectric layer 13 deforms into a cantilever-like shape. The part of the actuator plate 10 corresponding to the inner area C (or the part of the diaphragm 14 corresponding to the inner area C) is relatively greatly deflected in a direction away from the pressure chamber 21*a* under the influence of the deformation of the piezoelectric layer 13 as described above. Accordingly, the inner volume of the pressure chamber 21*a* is increased, leading to a negative pressure in the pressure chamber 21*a*. The pressure chamber 21*a* is thereby replenished with the ink as delivered from the liquid tank via the corresponding manifold 23*a* and manifold passage 22*b*.

After the pressure chamber 21*a* has been replenished with the ink, the switching device is turned off to terminate the application of the power supply voltage to the upper electrode 11 via the drive circuit. Thus, the contraction of the piezoelectric layer 13 in the planar direction is eliminated, restoring the actuator plate 10 to its original flat state as shown in FIG. 2. Accordingly, the inner volume of the pressure chamber 21*a* is reduced to increase the pressure in the pressure chamber 21*a*, thereby ejecting a droplet of the ink from the nozzle 24*a* delivered through the corresponding pressure passage 22*a* and nozzle passage 23*b*.

According to the above-described first embodiment, the contraction of the piezoelectric layer 13 upon its activation affects the diaphragm 14 at the part positionally corresponding to the entirety of the inner peripheral part of the pressure chamber 21*a*, thereby increasing the amount of displacement of the diaphragm 14 as a whole.

Second Embodiment

There will be described a second embodiment of the invention by reference to FIG. 5.

The second embodiment is mostly identical with the first embodiment with some exceptions, which will be described. The identical elements will be denoted by the reference numerals used in the first embodiment, and illustration thereof is omitted.

Figure 5:
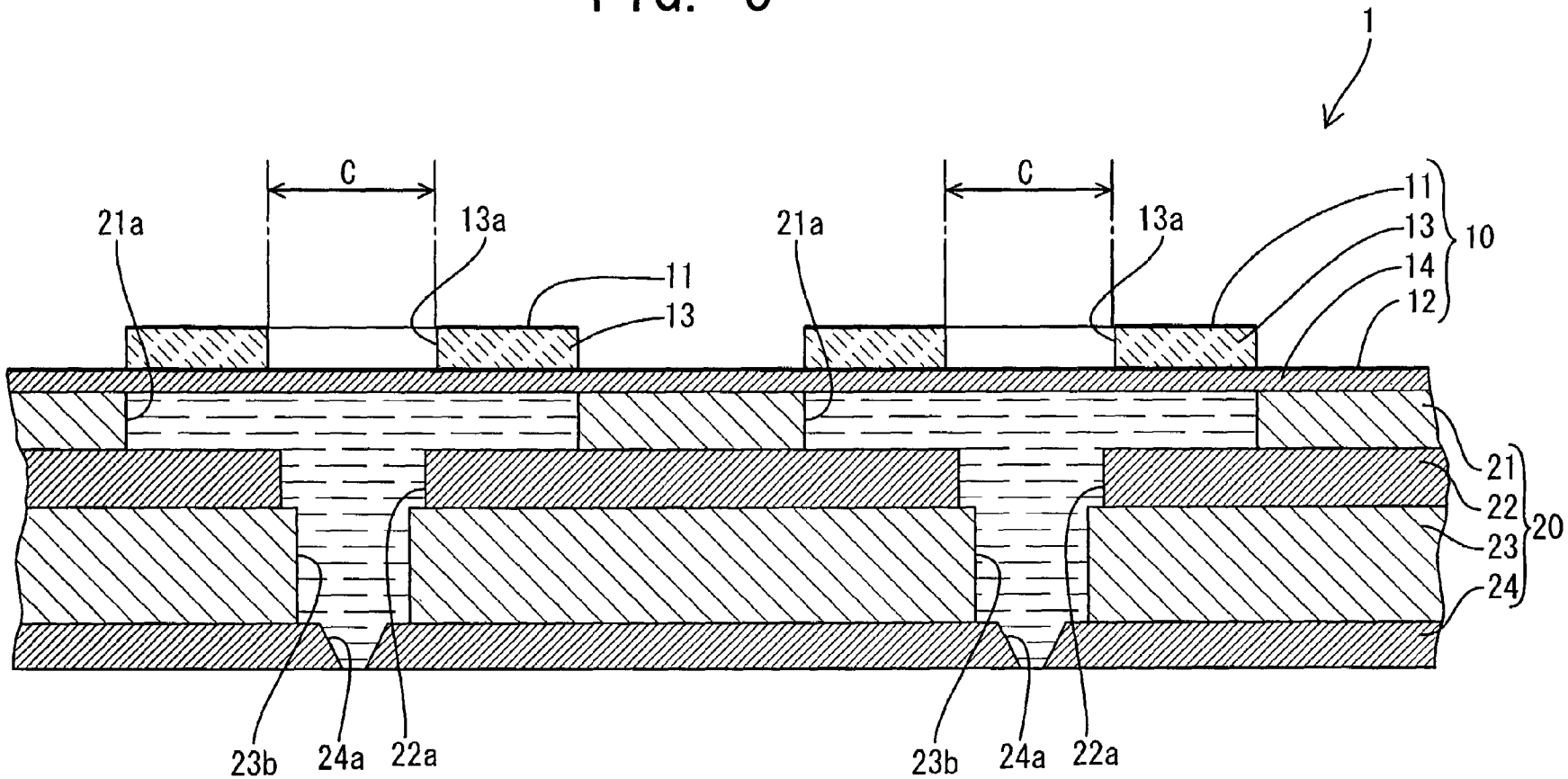
FIG. 5 is a view showing a part of a liquid delivery apparatus according to a second embodiment of the invention.

A liquid delivery apparatus 1 according to the second embodiment comprises a diaphragm 14 formed of an electrically non-conductive material, piezoelectric layers 13, and a lower electrode 12 interposed between the piezoelectric layers 13 and the diaphragm 14, as shown in FIG. 5. The lower electrode 12 operates to apply an electric field to each of the piezoelectric layers 13 at least a part of the piezoelectric layer 13 positionally corresponding to an inner peripheral part of a corresponding one of pressure chambers 21*a*. According to this arrangement, even where the diaphragm 14 is formed of an electrically non-conductive material, it is made possible to apply an electric field to the piezoelectric layer 13 disposed at the position corresponding to the inner peripheral part of the pressure chamber 21*a*. Although the lower electrode 12 shown in FIG. 5 is formed such that the lower electrode 12 extends over the plurality of pressure chambers 21*a*, it may be arranged such that a plurality of segments of the lower electrode may be disposed correspondingly to the respective pressure chambers 21*a*.

Third Embodiment

Figure 6:
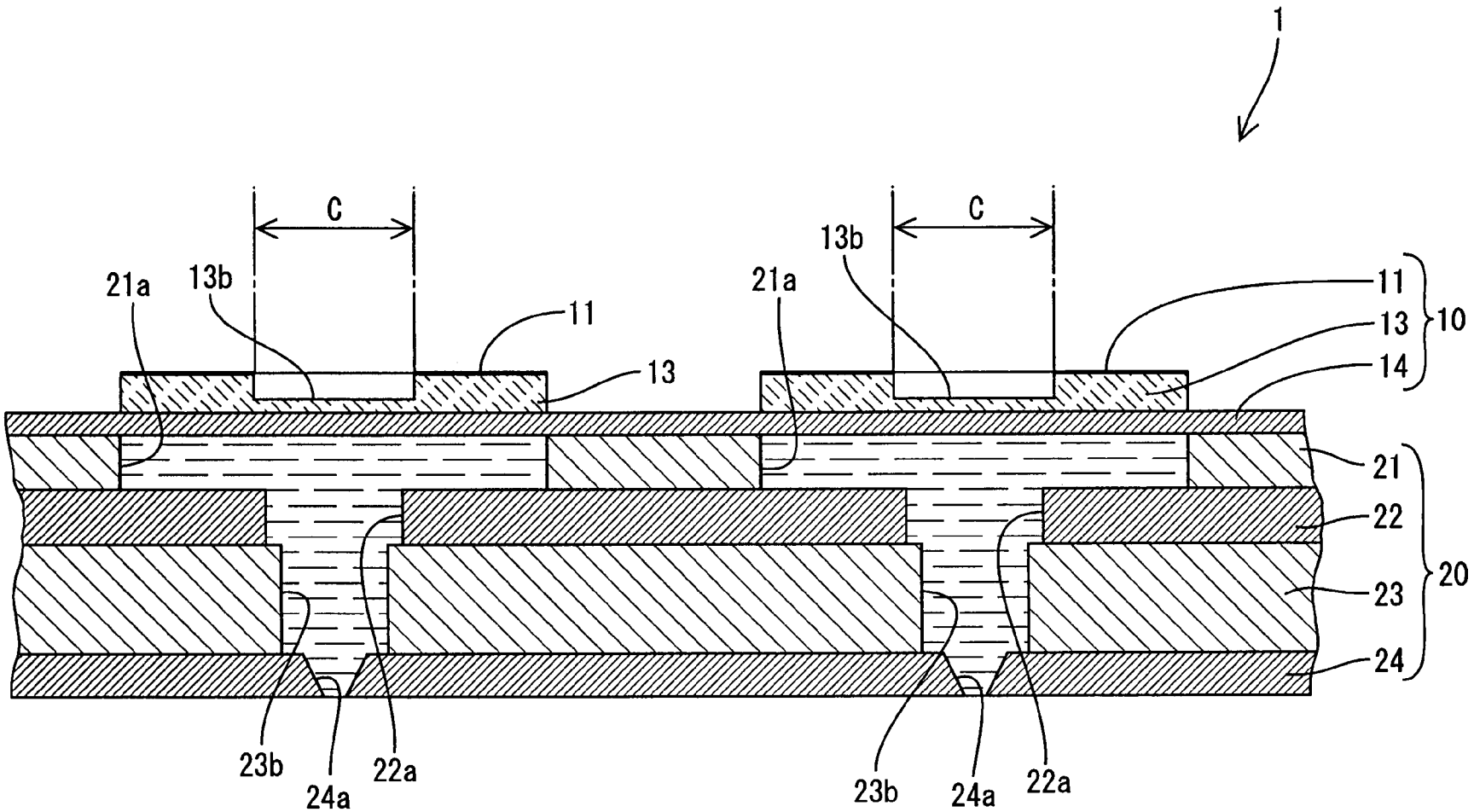
FIG. 6 is a view showing a part of a liquid delivery apparatus according to a third embodiment of the invention.

By reference to FIG. 6, there will be described a third embodiment of the invention.

The third embodiment is almost identical with the first embodiment with some exceptions, which will be described. The identical elements will be denoted by the reference numerals used in the first embodiment and illustration thereof is omitted.

In each of the first and second embodiments, the piezoelectric layer 13 is configured such that a void 13*a* is formed through the entire thickness of each piezoelectric layer 13 at the inner area C. However, piezoelectric layers 13 of the liquid delivery apparatus 1 according to the third embodiment are configured such that a halfway-through void is provided in each piezoelectric layer 13 at the inner area C. That is, as shown in FIG. 6, a part 13*b* of each piezoelectric layer 13 corresponding to the inner area C is made thinner than the other part or an annular thicker part of the piezoelectric layer 13 located over an inner peripheral part of a corresponding one of pressure chambers 21*a*. An electrode is not disposed on the thinner part 13*b*, and accordingly the piezoelectric layer 13 does not contract in its planar direction at the thinner part 13*b*. However, there may be disposed an electrode on the thinner part 13*b* also, as long as such an electrode is insulated from an upper electrode 11 disposed on the annular thicker part of the piezoelectric layer 13. Further, in a case where the thinner part 13*b* is coated with a low dielectric material, the upper electrode 11 can be formed over the entire surface of the piezoelectric layer 13. In either case, an electric field does not substantially arises at the thinner part 13*b* upon an application of an electric voltage to the upper electrode 11, and thus the piezoelectric layer 13 is not virtually deformed at the thinner part 13*b* by the piezoelectric effect. In the above-described latter case where the upper electrode 11 is provided on the entire surface of the piezoelectric layer 13 formed at the position corresponding to the pressure chamber 21*a*, an electric field does not substantially occur at the thinner part 13*b* which is coated with the low dielectric material. That is, an electric field is applied only to the part of the piezoelectric layer 13 other than the thinner part 13*b*, which is not coated with the low dielectric material. For instance, there are preferably employed as the low dielectric material: an insulative ceramic material such as silicon nitride (exhibiting a relative dielectric constant of 7.5), oxide silicon (exhibiting a relative dielectric constant of 3.9) and alumina (exhibiting relative dielectric constant of 9.6); and a resin material such as a low-dielectric photocurable resin (exhibiting a relative dielectric constant of 3.2) and one utilized for low-dielectric organic interlayer film (exhibiting a relative dielectric constant of 2.8). The low dielectric coating may be formed on the thinner part 13*b* by sputtering, evaporation or coating. In a case where a drive voltage of 20-30 V is applied to the upper electrode 11, a thickness of 1-3 μm is sufficient for the low dielectric coating to prevent an occurrence of an electric field at the thinner part 13*b* on which the low dielectric coating is formed.

Fourth Embodiment

Figure 7:
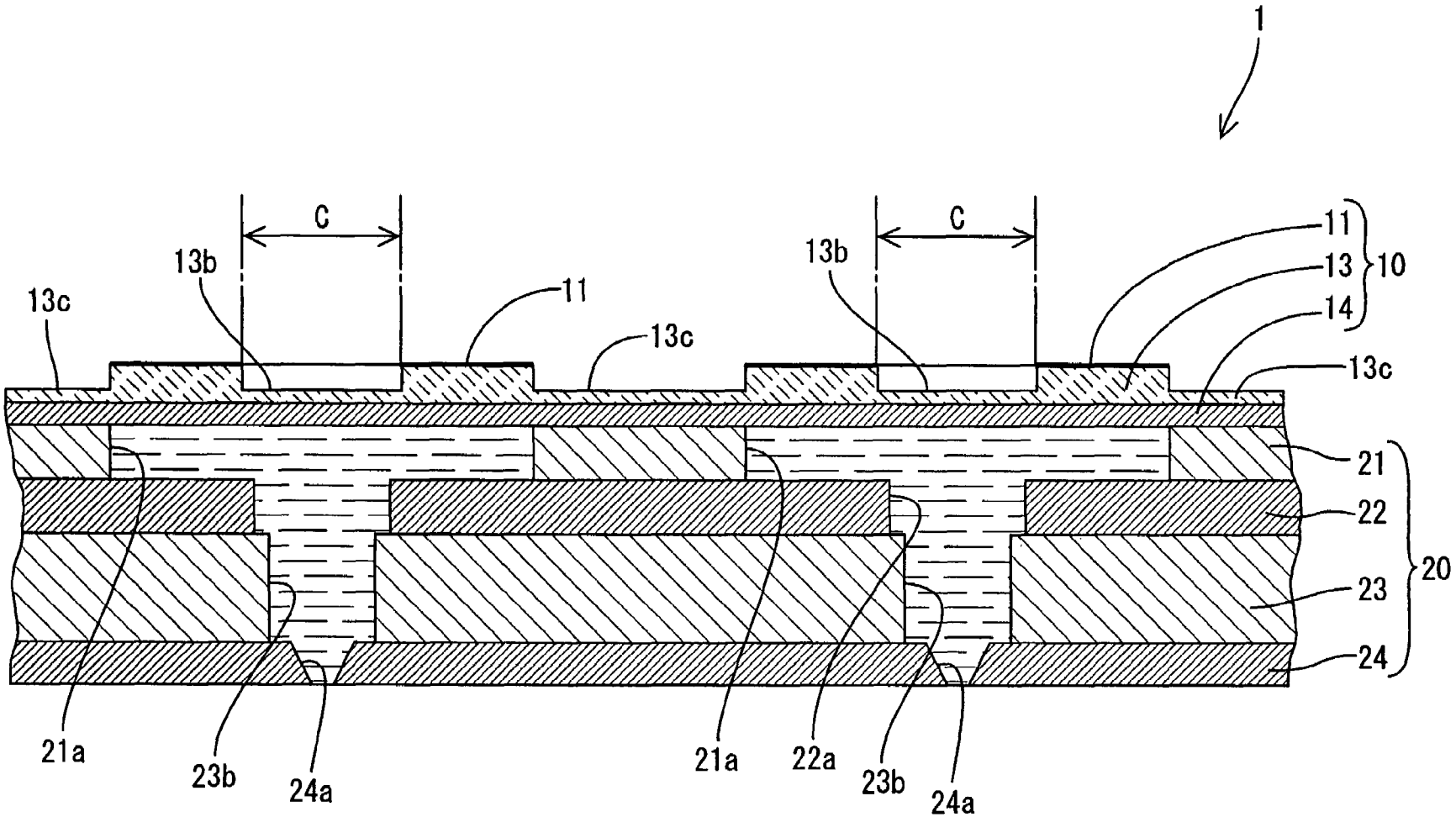
FIG. 7 is a view showing a part of a liquid delivery apparatus according to a fourth embodiment of the invention.

There will be described a fourth embodiment of the invention by reference to FIG. 7.

A liquid delivery apparatus 1 according to the fourth embodiment is arranged such that a piezoelectric actuator plate 10 extends over a plurality of pressure chambers 21*a*. More specifically, on a diaphragm 14 extending over the plurality of pressure chambers 21*a*, there is disposed a piezoelectric layer 13 as a single continuous member similarly extending over the plurality of pressure chambers 21*a*. The piezoelectric layer 13 according to the fourth embodiment is similar to the piezoelectric layers of the third embodiment in that a thinner part 13*b* is formed at each inner area C positionally corresponding to each pressure chamber 21*a*, such that each thinner part 13*b* is encircled by a thicker part on which an upper electrode 11 is disposed. The thicker part on which is disposed the upper electrode 11 and which is a part capable of contracting in its planar direction, has an annular planar shape, similar to the planar shape of each piezoelectric layer 13 in the first and second embodiments, as well as to the planar shape of the thicker part of each piezoelectric layer 13 in the third embodiment. However, the piezoelectric layer 13 of the fourth embodiment has at least one connecting part 13*c* which is formed such that the connecting part 13*c* connects adjacent two thicker parts (each of which is capable of contracting) and has a thickness thinner than that of the thicker parts. On the thinner part 13*b* and the connecting part 13*c* is not formed the upper electrode 11, and therefore these parts 13*b*, 13*c* are not capable of contracting in its planar direction. According to the fourth embodiment, the connecting part 13*c* having a relatively small thickness is located over side walls separating adjacent two pressure chambers 21*a*, as seen in a cross section of the apparatus 1. Hence, a local upward displacement of the piezoelectric actuator plate 10 caused when a pressure chamber 21*a* is activated does not easily affect the other part of the piezoelectric actuator plate 10 positionally corresponding to the other pressure chamber(s) 21*a* which is/are adjacent to the activated chamber 21*a*. That is, the fourth embodiment is effective to inhibit occurrence of a cross-talk. In this regard, as long as the upper electrode 11 is not formed on the connecting part 13*c*, a spontaneous displacement at the connecting part 13*c* by the piezoelectric effect does not occur, so that the connecting part 13*c* has no relation to the displacement of the other part of the piezoelectric layer 13 which positionally corresponds to the pressure chambers 21*a*. In this sense, without the upper electrode 11 thereon, it is not essential that the connecting part 13*c* is thinner than the part of the piezoelectric layer 13 on which the upper electrode 11 is formed, but the connecting part 13*c* may have a same thickness as the part of the layer 13 on which the upper electrode 11 is provided.

According to the arrangement according to the fourth embodiment, it is easy to dispose a piezoelectric layer over a plurality of pressure chambers, thereby improving the manufacturing efficiency.

Fifth Embodiment

Figure 8:
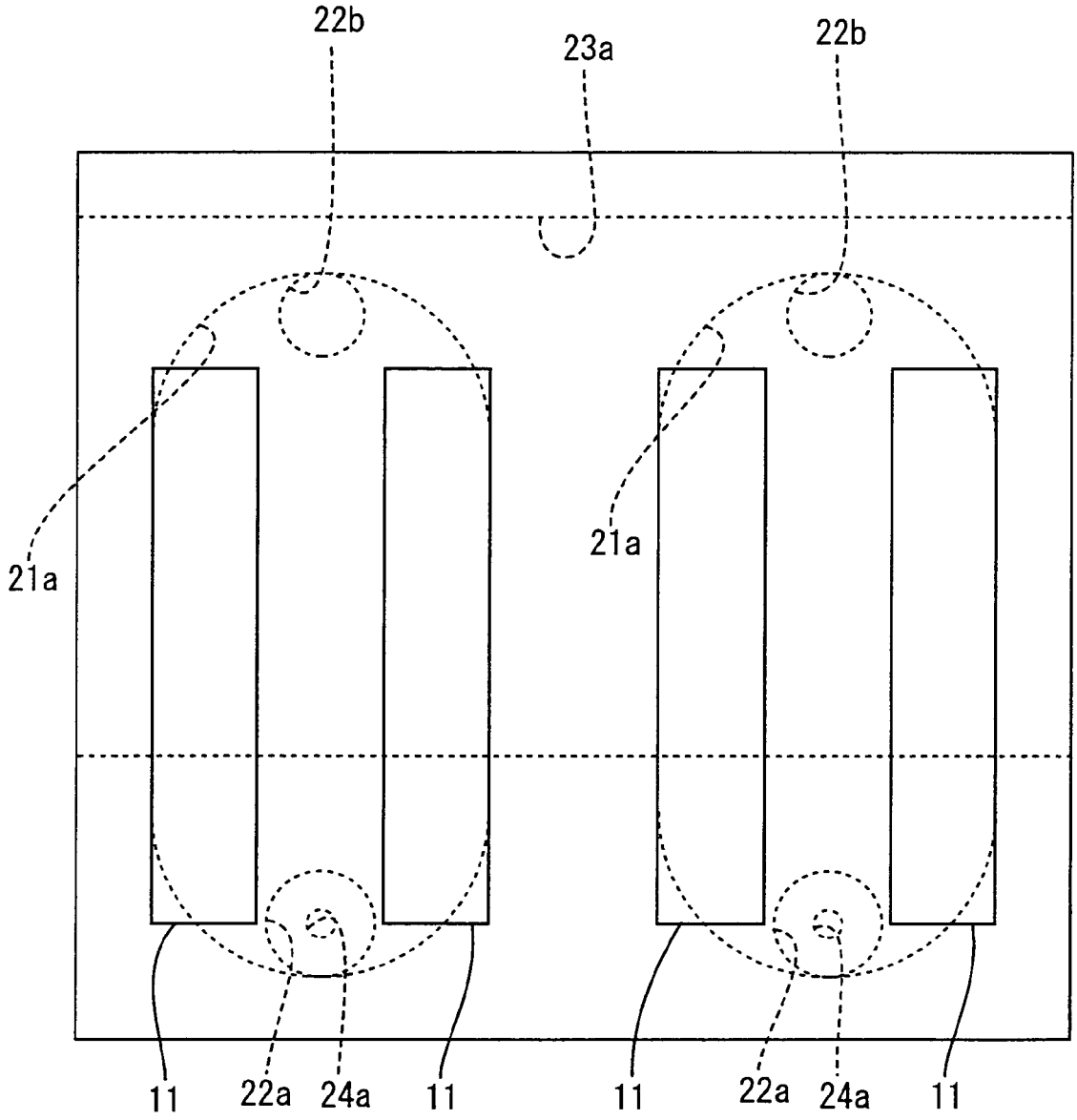
FIG. 8 is a plan view of a liquid delivery apparatus according to a fifth embodiment of the invention.

There will be described a fifth embodiment of the invention by reference to FIG. 8.

According to each of the first to fourth embodiments, a piezoelectric layer 13 is configured to have an annular planar shape or to have a thicker part having an annular planar shape. However, this is not essential but the piezoelectric layer 13 may have other shapes as long as the piezoelectric layer 13 is disposed at a position corresponding to the inner peripheral part of the pressure chamber 21*a*. According to the fifth embodiment, a piezoelectric actuator plate 10 is disposed such that a pair of segments of piezoelectric layer 13, each in a strip-like shape, extends in a longitudinal direction of the oblong pressure chamber 21*a*, and is located over the laterally opposite peripheral parts of the pressure chamber 21*a*. An upper electrode 11 having the substantially same shape as each segment of the piezoelectric layer 13 is disposed on each segment of the piezoelectric layer 13 extending over an almost entire length of the longer side of the pressure chamber 21*a*.

According to the fifth embodiment, the piezoelectric layer 13 can be simply configured, as well as the diaphragm 14 can be efficiently displaced by activation of the piezoelectric layer 13.

As described above, in each of the first through fifth embodiments, at least one of the pair of electrodes disposed on respective opposite sides of the piezoelectric layer to apply an electric field to the piezoelectric layer, is disposed at the position corresponding to the inner peripheral part of the pressure chamber, and not provided over the inner side of the inner peripheral part of the pressure chamber. That is, in each of the first through fourth embodiment, the at least one of the electrodes corresponds to the upper electrode disposed on the piezoelectric layer having the annular shape, while in the fifth embodiment the at least one electrode corresponds to the pair of segments each having the strip-like shape. Thus, the rigidity of the piezoelectric actuator plate can be reduced at the portion positionally corresponding to the inner side of the inner peripheral part of the pressure chamber.

Sixth Embodiment

Figure 9:
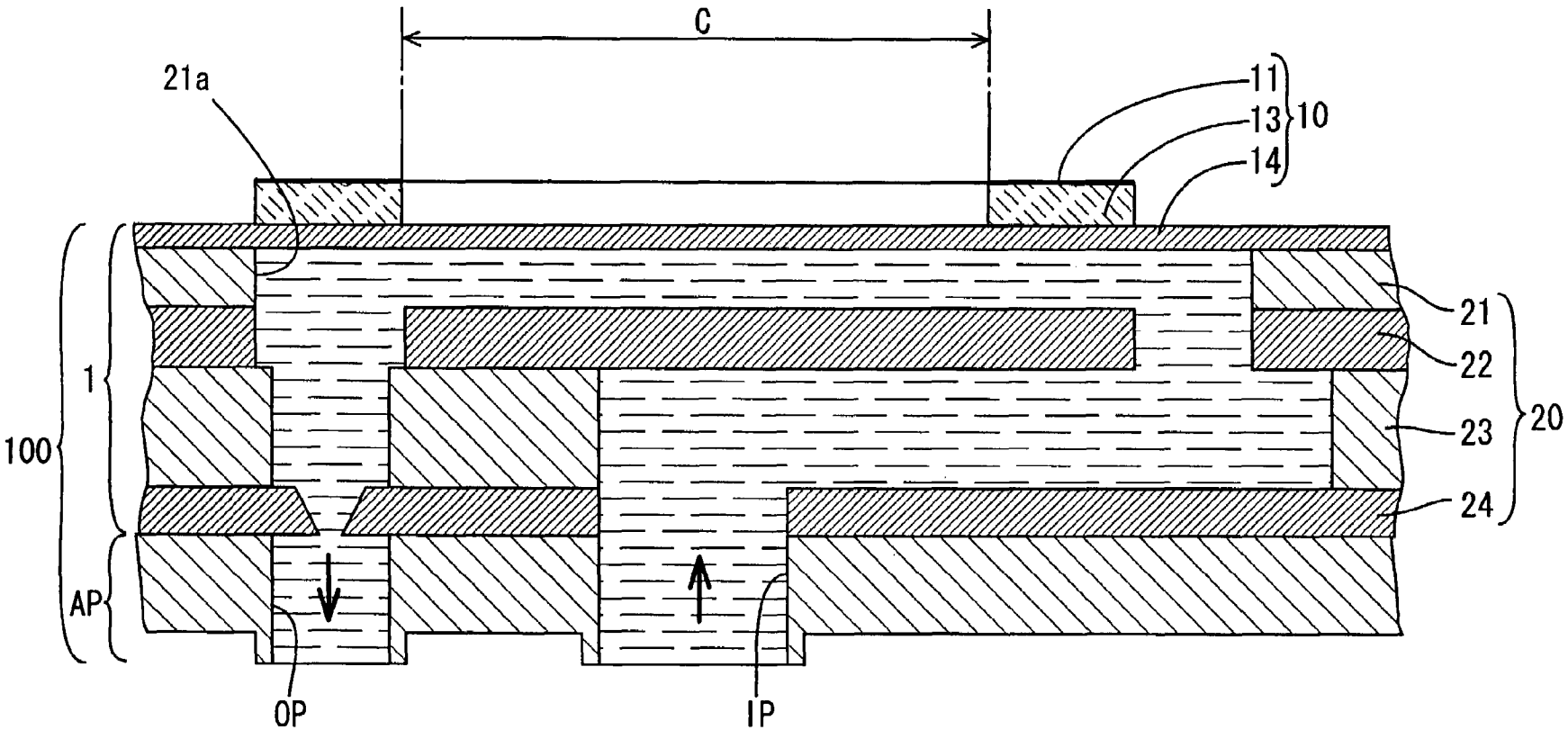
FIG. 9 is a view showing a part of a liquid delivery apparatus according to a sixth embodiment of the invention.

FIG. 9 shows a micropump 100 where a liquid delivery apparatus 1 according to the first embodiment of the invention is applied. The micropump 100 comprises the liquid delivery apparatus 1 and a pump adapter AP which is connected to an under surface of the liquid delivery apparatus 1. A lower part of the pump adapter AP is immersed in an ink source. The operation of this liquid delivery apparatus 1 is identical with that according to the first embodiment; namely, a part of a piezoelectric actuator plate 10 is deflected in a direction away from one of pressure chambers 21*a*, and an inner volume of the pressure chamber 21*a* is increased. The ink in the ink source is thereby sucked through an inlet IP into the apparatus 1, and is delivered via the pressure chamber 21*a* to the outside through a corresponding one of outlets OP.

OTHER EMBODIMENTS

It is to be understood that the present invention is not limited to the details of the above-described embodiments as shown in drawings, but the following modifications may also be included within the technical scope of the invention. Further, the invention may be embodied otherwise than the following embodiments, with various changes, without departing from the spirit of the invention.

(1) An upper electrode and a lower electrode may be connected to a ground and a positive voltage source of a drive circuit, respectively.

Further, in each of the above-described embodiments, the direction of polarization and that of electric field application are the same, and therefore the piezoelectric actuator plate 10 is deformed in a direction to increase the inner volume of the pressure chamber 21*a*. However, it may be arranged such that these directions are opposite to each other. In this case, the piezoelectric layer 13 contracts in the direction of its thickness to expand in its planar direction, and the piezoelectric actuator plate 10 is deformed in a direction to reduce the inner volume of the pressure chamber 12*a*.

(2) The liquid delivery apparatus according to the present invention may be embodied anywise in terms of the form of the liquid delivered to the outside through the opening in communication with the pressure chamber. That is, the liquid delivered through the opening may take any form, e.g., droplet or spray. In addition, the mode of the delivering the liquid may be anywise; for instance, the liquid may be jetted, ejected or sprayed.

(3) Although each of the above-described embodiments takes the form of an ink jet head of a printer, they are taken only for example and the present invention is applicable to any kind of a liquid delivery apparatus, such as a test-reagent jet apparatus.

(4) As described above, in the third embodiment the low dielectric coating is provided on the piezoelectric layer 13 at the inner area C where the thickness is smaller than the other part of the piezoelectric layer 13. By this arrangement, it is made unnecessary to bother to avoid the thinner part 13*b* when forming the upper electrode 11 on the piezoelectric layer 13. Such a low dielectric coating provided at the inner area C may be employed in the other embodiments, too. In the case where the low dielectric coating is formed at the inner area C, it is not essential that the thickness of the piezoelectric layer 13 is made smaller at the inner area C compared to the other part of the layer 13, when the low dielectric coating has a dielectric strength capable of withstanding a drive voltage applied to the upper electrode. Further, in the above-described embodiments, the diaphragm 14 may be formed of either an electrically conductive material or a non-conductive material. When the diaphragm 14 is formed of a non-conductive material, a lower electrode should be provided between the piezoelectric layer 13 and the diaphragm 14.

What is claimed is:

1. A liquid delivery apparatus comprising:

a pressure chamber accommodating a liquid; and a piezoelectric actuator plate which is disposed on one of opposite sides of the pressure chamber to close the pressure chamber and is deformed to deliver the liquid through an opening that is disposed on the other of the opposite sides of the pressure chamber to be held in communication with the pressure chamber, and which has a laminated structure including:

a piezoelectric layer which is deformable at least in a planar direction thereof by an application of an electric field to the piezoelectric layer; and a planar diaphragm laminated on the piezoelectric layer, wherein a rigidity of the piezoelectric actuator plate is lower at a portion thereof over an inner side of an inner peripheral part of the pressure chamber than at a portion thereof over the inner peripheral part that is located outside the inner side of the inner peripheral part of the pressure chamber.

2. The liquid delivery apparatus according to claim 1, wherein the diaphragm extends across the pressure chamber, and the piezoelectric layer is disposed over the inner peripheral part of the pressure chamber and does not extend over the inner side of the inner peripheral part of the pressure chamber.

3. The liquid delivery apparatus according to claim 1, wherein the diaphragm extends across the pressure chamber, and the piezoelectric layer has a first part extending over the inner peripheral part of the pressure chamber and a second part extending over the inner side of the inner peripheral part of the pressure chamber, the second part being thinner than the first part.

4. The liquid delivery apparatus according to claim 3, wherein a pair of electrodes are disposed on respective opposite sides of the piezoelectric layer to apply an electric field to the piezoelectric layer, and the second part of the piezoelectric layer is coated by a low dielectric material.

5. The liquid delivery apparatus according to claim 1, wherein the diaphragm is formed of an electrically conductive material and serves as one of a pair of electrodes that are disposed on respective opposite sides of the piezoelectric layer so as to apply an electric field to the piezoelectric layer.

6. The liquid delivery apparatus according to claim 1, wherein the diaphragm is formed of an electrically non-conductive material, and one of a pair of electrodes for applying an electric field to the piezoelectric layer is formed between the piezoelectric layer and the diaphragm at least at a position corresponding to the inner peripheral part of the pressure chamber.

7. The liquid delivery apparatus according to claim 2, wherein the piezoelectric layer has an annular shape corresponding to an entirety of the inner peripheral part of the pressure chamber.

8. The liquid delivery apparatus according to claim 3, wherein the first part of the piezoelectric layer has an annular shape corresponding to an entirety of the inner peripheral part of the pressure chamber.

9. The liquid delivery apparatus according to claim 2, wherein a cross section of the pressure chamber as taken in a direction parallel to the plane of the diaphragm has an oblong shape, and the piezoelectric layer includes a pair of segments each in a strip-like shape extending in a longitudinal direction oblong shape.

10. The liquid delivery apparatus according to claim 3, wherein a cross section of the pressure chamber as taken in a direction parallel to the plane of the diaphragm has an oblong shape, and the first part of the piezoelectric layer includes a pair of segments each in a strip-like shape extending in a longitudinal direction of the oblong shape.

11. The liquid delivery apparatus according to claim 1, wherein the piezoelectric actuator plate further includes a pair of electrodes disposed on respective opposite sides of the piezoelectric layer so as to apply an electric field to the piezoelectric layer, at least one of the pair of electrodes being disposed at the position corresponding to the inner peripheral part of the pressure chamber.

12. The liquid delivery apparatus according to claim 11, wherein the at least one of the pair of electrodes has an annular shape covering an area corresponding to an entirety of the inner peripheral part of the pressure chamber.

13. The liquid delivery apparatus according to claim 1, comprising a plurality of the pressure chambers, wherein the piezoelectric actuator plate includes the diaphragm extending over the pressure chambers and a plurality of the piezoelectric layers each provided over a corresponding one of the pressure chambers.

14. The liquid delivery apparatus according to claim 13, wherein each of the piezoelectric layers is disposed over at least the inner peripheral part of the corresponding pressure chamber, and adjacent two of the piezoelectric layers are connected to each other.

15. The liquid delivery apparatus according to claim 2, wherein a cross section of the pressure chamber as taken in a direction parallel to the plane of the diaphragm has an oblong shape, and a length of a shorter side of a part of the piezoelectric layer which positionally corresponds to the inner side of the inner peripheral part of the pressure chamber is not smaller than one third of a length of a shorter side of the oblong shape.

16. The liquid delivery apparatus according to claim 3, wherein a cross section of the pressure chamber as taken in a direction parallel to the plane of the diaphragm has an oblong shape, and a length of a shorter side of the thinner second part is not smaller than one third of a length of a shorter side of the oblong shape.

17. The liquid delivery apparatus according to claim 1, which serves as a print head of an ink jet printer, wherein an ink accommodated as the liquid in the pressure chamber which is ejected from the opening in communication with the pressure chamber.

18. A micropump comprising:

the liquid delivery apparatus according to claim 1; and a pump adapter connected to the liquid delivery apparatus and having an inlet and an outlet which are in communication with the pressure chamber and the opening of the liquid delivery apparatus, respectively, the inlet being immersed in a source of the liquid so that the liquid is sucked into the micropump through the inlet and delivered to the outside of the micropump through the outlet, via the pressure chamber and the opening.

19. A liquid delivery apparatus comprising:

a pressure chamber accommodating a liquid; and a piezoelectric actuator plate which is disposed on one of opposite sides of the pressure chamber to close the pressure chamber and is deformed to deliver the liquid through an opening that is disposed on the other of the opposite sides of the pressure chamber to be held in communication with the pressure chamber, the actuator plate having a laminated structure including:

a piezoelectric layer which is deformable at least in a planar direction thereof by an application of an electric field to the piezoelectric layer; and a planar diaphragm laminated on the piezoelectric layer, wherein a rigidity of the piezoelectric actuator plate is lower at a portion thereof over an inner side of an inner peripheral part of the pressure chamber than at a portion thereof over the inner peripheral part of the pressure chamber.

20. A liquid delivery apparatus comprising:

a pressure chamber accommodating a liquid; and a piezoelectric actuator plate which is disposed on one of opposite sides of the pressure chamber to close the pressure chamber and is deformed to deliver the liquid through an opening that is disposed on the other of the opposite sides of the pressure chamber to be held in communication with the pressure chamber, and which has a laminated structure including:

a piezoelectric layer which is deformable at least in a planar direction thereof by an application of an electric field to the piezoelectric layer; and a planar diaphragm laminated on the piezoelectric layer, wherein a rigidity of the piezoelectric actuator plate is lower at a portion thereof over an inner side of an inner peripheral part of the pressure chamber than at a portion thereof over the inner peripheral part of the pressure chamber, and wherein the piezoelectric actuator plate is deformed upon deformation of the piezoelectric layer that is caused by the application of the electric field to the piezoelectric layer, such that an inner volume of the pressure chamber is increased by deformation of the piezoelectric actuator plate.

* * * * *